US008263148B2

(12) United States Patent
Yoakim et al.

(10) Patent No.: US 8,263,148 B2
(45) Date of Patent: Sep. 11, 2012

(54) CAPSULE FOR PREPARATION OF A BEVERAGE WITH A DELIVERY WALL FORMING A CONFINED FLOWPATH

(75) Inventors: Alfred Yoakim, St. Legier-la Chiesaz (CH); Patrice Borne, Publier (FR)

(73) Assignee: Nestec S.A., Vevey (CH)

( * ) Notice: Subject to any disclaimer, the term of this patent is extended or adjusted under 35 U.S.C. 154(b) by 169 days.

(21) Appl. No.: 12/756,865

(22) Filed: Apr. 8, 2010

(65) Prior Publication Data

US 2010/0260895 A1 Oct. 14, 2010

(30) Foreign Application Priority Data

Apr. 9, 2009 (EP) ..... 09157702
Aug. 26, 2009 (EP) ..... 09168663

(51) Int. Cl.
*B65B 29/02* (2006.01)
*A47J 31/06* (2006.01)

(52) U.S. Cl. ..... 426/77; 99/295; 99/279; 99/300

(58) Field of Classification Search ..... 426/77; 99/295, 495, 279, 300
See application file for complete search history.

(56) References Cited

U.S. PATENT DOCUMENTS

| | | | | |
|---|---|---|---|---|
| 3,292,527 | A | 12/1966 | Stasse | 99/295 |
| 4,053,371 | A | 10/1977 | Towsley | 204/20 |
| 4,846,052 | A | 7/1989 | Favre et al. | 99/295 |
| 4,853,234 | A | 8/1989 | Bentley et al. | 426/77 |
| 4,886,674 | A | 12/1989 | Seward et al. | 426/79 |
| 5,242,702 | A | 9/1993 | Fond | 426/433 |
| 5,402,707 | A | 4/1995 | Fond et al. | 99/295 |
| 5,472,719 | A | 12/1995 | Favre | 426/77 |
| 6,832,542 | B2 | 12/2004 | Hu et al. | |
| 7,393,446 | B2 | 7/2008 | Towsley | 205/109 |
| 2003/0096038 | A1 | 5/2003 | Cai | 426/77 |
| 2004/0115310 | A1 | 6/2004 | Yoakim et al. | 426/77 |
| 2004/0115317 | A1 | 6/2004 | Doglioni | 426/123 |
| 2005/0150390 | A1 | 7/2005 | Schifferle | 99/295 |
| 2006/0110507 | A1 | 5/2006 | Yoakim et al. | 426/433 |
| 2007/0186784 | A1 | 8/2007 | Liverani et al. | 99/295 |
| 2007/0224319 | A1 | 9/2007 | Yoakim et al. | 426/433 |
| 2007/0261564 | A1 | 11/2007 | Liverani et al. | 99/279 |
| 2009/0280219 | A1 | 11/2009 | Yoakim et al. | 426/77 |

FOREIGN PATENT DOCUMENTS

| | | |
|---|---|---|
| BE | 1 006 165 A5 | 5/1994 |
| EP | 0 179 641 B1 | 4/1986 |
| EP | 0 242 556 A1 | 10/1987 |

(Continued)

OTHER PUBLICATIONS

Search Report, European Application No. 09155571, Oct. 9, 2009.

(Continued)

*Primary Examiner* — Rena Dye
*Assistant Examiner* — Chaim Smith
(74) *Attorney, Agent, or Firm* — Winston & Strawn LLP

(57) ABSTRACT

A capsule for preparation of a beverage in a beverage production machine that includes a body and a delivery wall forming a chamber containing an extractable beverage ingredient, The delivery wall has at least one outlet, an inner layer including at least one first orifice and an outer layer including at least a second orifice, with the first and second orifices extending in the axial direction of the capsule, The first and second layers are adjacent or the first and second layers are distant by a confined gap and when a gap is present, a labyrinth structure is provided which extends transversally in the gap between the first and second orifices.

19 Claims, 4 Drawing Sheets

FOREIGN PATENT DOCUMENTS

| | | | |
|---|---|---|---|
| EP | 0 468 078 | A1 | 1/1992 |
| EP | 0 512 468 | B1 | 11/1992 |
| EP | 0 512 470 | B1 | 11/1992 |
| EP | 0 554 469 | B1 | 8/1993 |
| EP | 0468079 | B1 | 9/1996 |
| EP | 1 165 398 | B1 | 1/2002 |
| EP | 1 273 528 | B1 | 1/2003 |
| EP | 1 579 792 | B1 | 9/2005 |
| EP | 1 654 966 | B1 | 5/2006 |
| EP | 1 700 548 | B1 | 9/2006 |
| EP | 1 702 543 | B1 | 9/2006 |
| EP | 1 929 904 | A1 | 6/2008 |
| WO | WO 02/058522 | A1 | 8/2002 |
| WO | WO 02/081337 | A1 | 10/2002 |
| WO | WO 03/073896 | | 9/2003 |
| WO | WO 2005/092160 | A1 | 10/2005 |

OTHER PUBLICATIONS

Search Report, European Application No. 09155575, Oct. 7, 2009.
Search Report, European Application No. 10156614, Jun. 24, 2010.
European Search Report, application No. EP 10158804 dated Jun. 18, 2010.

CAPSULE FOR PREPARATION OF A BEVERAGE WITH A DELIVERY WALL FORMING A CONFINED FLOWPATH

BACKGROUND

The present invention relates to a capsule for preparing a beverage containing extractable beverage ingredients such as coffee in a beverage production machine.

Single-use beverage capsules are very popular because they provide a fresh tasting beverage quickly, conveniently and in a clean fashion. Therefore, certain beverage capsule systems propose to extract a coffee liquid from roast and ground coffee ingredients contained in a capsule that opens under pressure when a sufficient amount of water has filled the capsule. More particularly, the pressure of liquid increases in the capsule before the delivery face of the capsule opens thereby conferring a good quality of extraction.

In order to provide a thorough interaction between the beverage extractable ingredients, e.g., ground coffee and hot water, it is desirable to delay the release of the beverage through the delivery side. Many different solutions already exist.

In particular, the NESPRESSO® capsule system, as described in EP0512470B1, is based on the principle that an extraction face of the capsule is torn against relief and recessed elements of a capsule holder in the beverage production machine. The extraction face tears at the location of these relief elements and/or recessed elements on reaching the breaking stress to enable the liquid, e.g., coffee extract, to be removed after extraction of the coffee under a certain positive pressure. EP0512468B1 also describes a capsule which is adapted for such extraction process and device.

It exists other methods for providing one or more orifices in the delivery wall due to the internal pressure of the injected liquid, such as involving no (external) perforating elements foreign to the capsule.

It also exists capsules comprising a delivery wall with prefabricated orifices, i.e., which is not opened under the effect of the liquid under pressure in the capsule. However, most of the time, the orifices are configured in their positioning, number and size in the delivery wall to generate a negligible back-pressure causing only a low pressure rise in the capsule. As a result, a relatively poorly extracted and soapy liquid, e.g., "clear" coffee, is produced in the capsule and delivered from it. Thus, improvements over these devices are needed.

SUMMARY OF THE INVENTION

The present invention aims at solving the above-mentioned problems and offering solutions for providing a better interaction water-ingredients in the capsule, in particular, for a capsule comprising prefabricated orifices in its delivery wall in order to provide an elevated pressure in the capsule during extraction.

To achieve this, the invention relates to a capsule for preparation of a beverage in a beverage production machine comprising a body and a delivery wall forming a chamber containing an extractable beverage ingredient, with the delivery wall comprising at least one outlet, an inner layer including at least a first orifice and an outer layer including at least a second orifice, wherein the first and second orifices extend in the axial direction of the capsule. Also, the first and second layers are adjacent or the first and second layers are distant by a confined gap and when a gap is present, a labyrinth structure is provided which extends transversally across the beverage flowpath in the gap between the first and second orifices.

The capsule generally contains particles for formation of a beverage upon contact with a fluid that is injected into the capsule.

BRIEF DESCRIPTION OF THE DRAWINGS

Preferred features of the invention are shown in the appended drawing figures wherein.

DETAILED DESCRIPTION OF THE INVENTION

Figure 1:
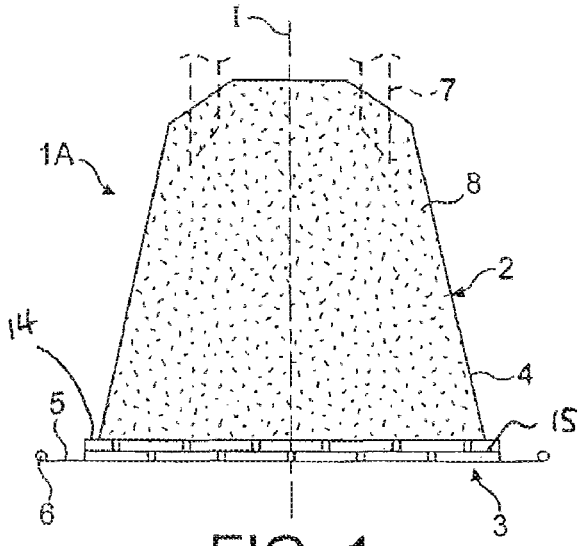
FIG. 1 is a cross section view of a capsule according to a first embodiment of the invention.

As used herein, the term "axial direction" refers to the longitudinal axis of symmetry of the capsule corresponding in use to the main direction of the liquid flow through the chamber. The "transversal direction" refers to a direction extending in a plane normal or slightly inclined (i.e., less than 45 degrees) to said longitudinal axis.

By "adjacent" it is meant that the layers are in direct contact or distant one another of no more than 0.3 mm (when the capsule is not submitted to the inside pressure of liquid) along at least 75% of their total surfaces.

The term "orifices" means any orifice provided in the delivery wall for allowing the beverage to leave the capsule. The orifice may be preformed in the delivery wall. The delivery wall may thus comprise one or a plurality of orifices. The orifices may also be formed by a mechanical or fluidic process before or during the preparation of the beverage. For instance, one or a plurality of orifices can be formed by piercing or cutting when the capsule is inserted in the beverage production machine or as a result of a mechanical stress or another stress provided by liquid, gas pressure, heat, laser and combinations thereof. Therefore, the orifices may not be materialized before use of the capsule but may appear at use of the capsule.

In a preferred mode, the second orifice(s) is (are) offset relative to the first orifice(s) in the transversal direction of the capsule. As a result, the flow of beverage, e.g., coffee liquid extract is forced to take a transversal path between the two layers rather than a direct axial path before leaving the delivery wall and thereby slows down the path of beverage.

In a mode, the path between the first orifice(s) and/or second orifice(s) is sealed. The sealing may be obtained by any suitable way. Sealing may be obtained by the inner and/or outer layer itself or by an additional layer, e.g., intermediate sealing layer inserted between the two layers.

In a mode, the flow path between the first and second orifice(s) is opened by the internal pressure applied to the delivery wall during extraction. In a one mode, the flowpath is closed by a seal (e.g., delaminating area) being present between the inner and outer layers between the inner and outer orifices. In particular, the flowpath can be closed by closed orifices. The orifices can be closed but preweakened such by a low thickness membrane or by an adhesive layer covering the orifice(s). The orifice(s) can be thereby be unsealed by any suitable manner such as delaminating, breakage, self-perforation, etc.

In another mode, the flow path between the first and second orifices is let open, i.e., not closed or sealed. The flow path can anyway be hindered in the axial and/or transversal direction of the path by restrictions such as flow channels. These restrictions are placed between the first and second orifices of the two layers.

In another mode, the first and second orifices are prefabricated and a sealing material at least partially seals the path between the first and second orifices. Such sealing material can be inserted to attach the inner and outer layers together, e.g., in an adjacent manner.

Preferably, the delivery wall further comprises one or more restriction opening(s), e.g., channel(s), between the two layers and extending along the transversal direction of the capsule.

The restriction opening provides a resistance to the flow of beverage enabling to maintain an elevated pressure in the chamber of the capsule. The restriction opening also contributes to the formation of foam or coffee "crema" by creating shear forces associated to a sudden release of pressure of liquid. Therefore, the restriction opening(s) preferably forms an overall open surface area between 0.25 and 2.5 $mm^2$. When several openings are provided, the "overall open surface area" represents the sum of each individual surface area of the openings.

When the openings are formed by selective sealing of flexible layers, e.g., thin polymer foils forming a two-dimensional wall at rest; the surface area of the opening is taken as the largest possible surface area, without breakage of the seal delimiting the opening, of the opening which forms when a liquid is passed through the opening.

Preferably, the transversal flow restriction opening(s) has (have) a larger dimension of less than 1 mm, preferably less than 0.7 mm.

By "larger dimension", it is meant the largest dimension in transversal cross section of each opening, i.e., the diameter for a circular opening or the length for an elongated slot-opening. For example, for a two-dimensional delivery wall obtained by selective sealing of the two layers, the largest dimension is the width of the unsealed portion of the layers at the restriction.

Preferably, the number of transversally oriented restriction openings is lower than 5, most preferably lower between 1 and 4. The opening can be prefabricated so that their dimension is fixed before use of the capsule. However, it may be envisaged that the opening is obtained by breaking or piercing during use or just before injection of liquid in the capsule. For instance, the opening may be sealed by a seal designed to break by the effect of liquid under pressure between the two layers.

Preferably, the inner and outer layers are selectively and partially fixedly sealed together to leave said transversal opening(s).

In particular, the transversal opening(s) is (are) formed in an unsealed portion of the layers and delimited by a sealed portion connecting the inner layer to the outer layer.

In another possible mode, the transversal opening(s) is (are) formed or delimited by a rigid insert sealed between the inner and outer layers.

When a gap is present between the two layers and a labyrinth structure is so necessary to form a confined and tortuous flowpath, the labyrinth structure is preferably arranged to leave one or more flow restriction openings extending in the transversal direction of the capsule.

In general, the inner layer and/or outer layer comprise a plurality of orifices. However, the outer layer has preferably a limited number of orifices, e.g., less than 20 orifices, more preferably between 1 and 10 orifices.

In a mode, the first orifice(s) of the first layer has (have) a diameter small enough to maintain the extractable ingredients particles in the chamber.

Preferably, the mean diameter of the orifices of the first layer is smaller than 150 microns, preferably smaller than 100 microns. As a result, the layer can substantially retain in the chamber of the capsule beverage extractable particles, in particular ground coffee particles.

Preferably, the inner and outer layers are disc-shaped.

The layers can be formed of flexible foils forming a two-dimensional delivery wall at rest and which deforms to create a confined beverage flowpath between the two layers. In particular, the foils can be partially sealed to form the restriction opening(s) by unsealed regions in two dimensions when the capsule is not submitted to the liquid pressure. In particular, the inner and outlet layers can be flexible foils having a thickness between about 50 to 250 microns.

The layers can also be a combination of flexible and rigid elements with one the layer forming the wall structure in labyrinth.

Preferably, the first layer comprises aluminium, PP, PE, PA, PS, PVDC, EVOH, PET, PET, cellulose, starch-based material and combinations thereof and the second layer comprises aluminium, PP, PE, PA, PS, PVDC, EVOH, PET, cellulose, starch-based material and combinations thereof.

The terms "inner" and "outer" refer to the positioning of the layers one relative to the other in the delivery wall. However, they should not be interpreted as limiting the delivery wall to only two layers. For example, an outermost layer could be provided to serve as a filter or gas-tight closure membrane.

The extractable ingredient encompasses beverage ingredients such as ground coffee, leaf tea, milk powder or concentrate, chocolate or cocoa powder or concentrate and combinations thereof.

The capsule preferably contains added inert gas such as nitrogen to reduce oxidation and extend freshness period of the ingredient. Nitrogen is typically flushed after or during filling the capsule with the ingredient and before sealing.

Regarding the dimensions of the capsule, the delivery wall of the capsule has preferably a diameter between 30 and 40 mm. The body of the capsule has preferably a height comprised between 27 and 30 mm. The rim of the capsule has preferably a width comprised between 3 and 5 mm.

Preferably, the rim of the capsule comprises a sealing means for providing a liquid-tight seal effect between a pressing surface of the injection part and the capsule. The seal means is dimensioned effectively to improve the liquid pressure engagement of the capsule in the device and additionally to fill radial grooves formed at the end pressing surface of the injection part (as described in EP1654966 or EP1702543) to facilitate removal of the capsule from the device. More preferably, the sealing means forms at least one integral protrusion or lip extending from the rim or be an added seal element such as rubber, soft plastic, foam or fibres (e.g. paper, cardboard or synthetic or natural fibres).

A first embodiment of the capsule 1A of the present invention is illustrated in FIGS. 1, 1A, 2 and 3. The capsule 1A comprises a delivery wall 3 and a self-supporting cup-shaped body 2 of circular section with an upper closed part intended for the injection of water in the capsule; a truncated sidewall 4, a rim 5 extending outwardly and terminated by a curled end 6. As aforementioned, the body can be made of aluminium, plastic, paper, material obtained from agro-resources such as corn starch (preferably with plasticizer) and combinations thereof. The body may be relatively stiff to not collapse when it is perforated by blades 7 of the coffee production machine; which blades provide openings through the capsule for the water injection. The cup-shaped body defines a chamber 8 containing the extractable beverage ingredients, preferably roast and ground coffee. The dose of roast and ground coffee may vary depending on the type of coffee (ristretto, espresso or lungo). Generally, the amount of coffee contained in the chamber is of between 4.5 and 7 grams. The coffee powder is generally a single origin or a blend of different origins of Arabica and/or Robusta ground coffee. It should be noted that the body could take different other shapes and configurations. For instance, it could be made of different walls assembled together instead of being a cup-shaped member.

Figure 1A:
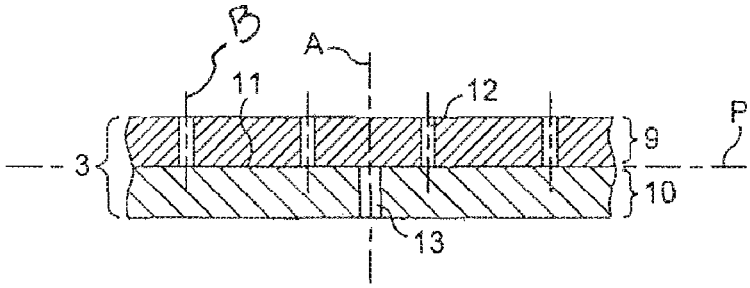
FIG. 1A is a detail view of the delivery wall of the capsule of FIG. 1.

As illustrated in FIG. 1A in detail, the delivery wall 3 is formed of a first and second layers, respectively, an inner layer 9 and an outer layer 10. The two layers are placed adjacent and are sealed only along their periphery seal line 15.

Figure 3:
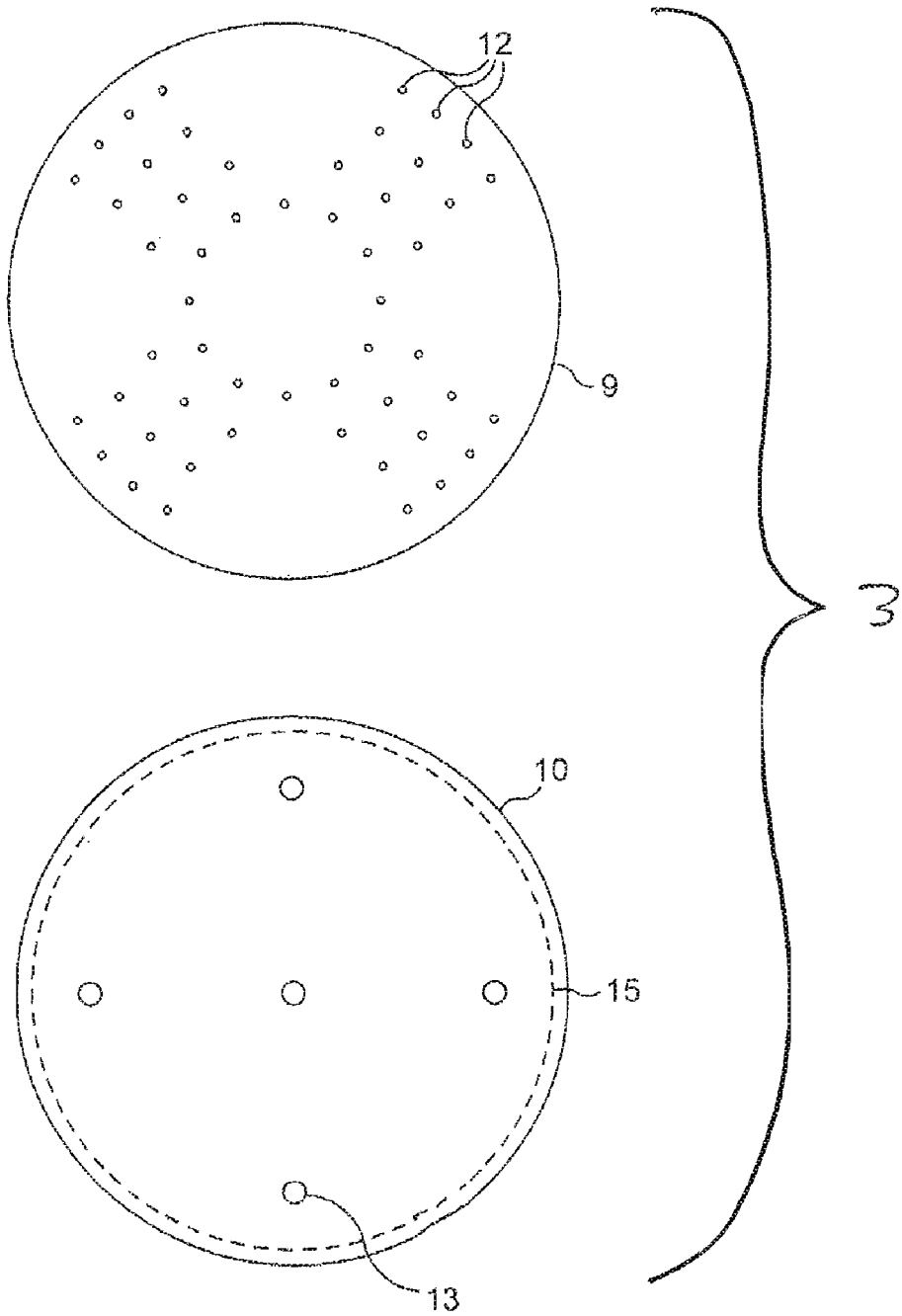
FIG. 3 is an exploded view of the delivery wall of the capsule of FIG. 1.

In a first mode, the two layers are substantially free of any seal connection at the interface 11, in particular, in the flow-path between the first and second orifices. Preferably, the first layer 9 is permeable to liquid by means of a plurality of small-size orifices 12 provided in its thickness. The orifices 12 forms pores through the layer of a diameter which is preferably below the average diameter ($D_{4,3}$) of the coffee particles contained in the chamber 8. The orifices are preferably distributed in the layer 9 to ensure the coffee extract can flow through substantially the entire surface of the layer (FIG. 3). This ensures that no privileged flowpaths are created in the bed of ingredient in the chamber but all the extractable beverage particles (e.g., coffee particles) are properly wetted by liquid.

The second (outer) layer 10 is also made permeable to liquid by orifices 13. The second orifices 13 form the outlet of the capsule for the delivered beverage. Each orifice 13 of the second layer is thus arranged along an axis A which is substantially parallel to the longitudinal axis L of the capsule. The number and size of these second orifices 13 may differ in the number and size from the first orifices 12. Preferably, the outer layer provides a higher back-pressure than the first layer. In particular, the second layer 10 has a lower number of orifices than the first layer 9 but orifices can be of same or larger individual diameter. Overall, the open surface area in the outer layer created by the orifice(s) 13 is preferably smaller than the open surface area in the inner layer created by the orifice(s) 12. In possible another mode, the open surface of the outer layer created by the orifice(s) 13 is greater than the open surface of the inner layer created by the orifice(s) 12.

As illustrated in FIG. 1A, the delivery wall is arranged by contact of the two layers along their surface in a manner that the layers 9, 10 are adjacent one another (before the liquid pressure in the capsule) and the second orifices 13 are offset relative to the first orifices 12. By "offset" it means that the axis A of the orifice 13 is not aligned to any of the axis B of orifices 12. As illustrated in FIG. 3, the first orifices 12 are placed and distributed through the inner layer in regions which differ from the regions which comprise the second orifices 13 through the second layer.

The delivery wall 3 can be inserted and sealed into an annular recess 14 of the body, e.g., obtained by a stepped portion of the sidewall 4, as illustrated in FIG. 1. Alternatively, the wall 3 can be sealed to the flange-like rim 5. Still another option is to seal the first layer 9 into the recess 14 and the second layer 10 onto the flange-like rim 5. In particular, the two layers can be sealed at their periphery with the tear-resistant seal peripheral portion 15 (FIG. 3). Therefore, the outer layer 10 cannot entirely detach from the capsule during extraction but remains solidly maintained in connection with the inner layer 9 at least in certain areas such as at the seal line 15.

Figure 2:
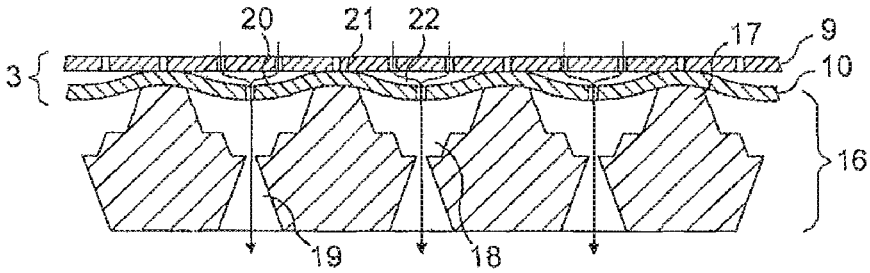
FIG. 2 PRIOR ART
FIG. 2 is a detailed view of the delivery wall on a capsule holder such as described in EP0512470 during beverage extraction.

In second mode of the embodiment of FIGS. 1, 1A, and 2, the flow path between the orifices 12 of the inner layer and the orifices 13 of the outer layer are closed by a sealing interface or portion 11. For this the seal portion 11 connects the first and second layers 9, 10 together and is arranged along a seal plane P which is oriented at about 90 degrees relative to the axis A of each orifice 13. As a matter of fact, the seal portion closes the flow path for liquid from the first orifices 12 to the second orifices 13.

The seal portion is made such that it can break or delaminate when a sufficient pressure of liquid acts thereon and/or onto the second layer 10 after having passed the first orifices 12. The seal portion can be made of a thermofusible material or an adhesive which is added between the two layers such as a thin sealing film (e.g., PE, EVA, etc.). The sealing film can be very thin, e.g., of several microns only. It can also be an integral part of the layers 9, 10 to form a breakable bond obtained such as by heat sealing. For instance, the two layers can be produced by laminating two permeable sheets under heat and pressure such as using heated rolls or a press. An intermediate fusible film may be necessary to obtain a breakable seal between the two sheets. The laminate is then cut to form circular delivery walls which can be sealed to the body 2 of the capsule. It should be noted that the flow path could also be closed or sealed by sealing the orifice(s) 12 and/or 13 independently without creating a bond between the inner and outer layers 9, 10. The sealed orifice(s) is (are) then opened or unsealed by the pressure of liquid in the capsule.

FIG. 2 illustrates the behaviour of the delivery wall when submitted to the extraction pressure of coffee liquid in the capsule. The capsule is typically inserted in a beverage production device such as described in EP0512470B1. The device comprises a capsule holder 16 onto which the capsule is supported and compressed. The capsule holder 16 has a series of relief elements 17 such as two-stage truncated pyramids and recessed elements or channels 18. The channels communicate with each other to form a collecting network for the liquid extract. In the bottom of the recessed elements 18 are provided small orifices 19 for allowing the liquid extract to flow through the capsule holder towards a delivery duct of the device (not shown). As water is filled in the chamber of the capsule through the perforations provided by the blades 7, the solid coffee ingredients are wetted by the liquid that progressively fills the chamber until a pressure builds up in the chamber. For example, when coffee is to be brewed, the particles are preferably roast and ground coffee. Coffee extract is formed by interaction between hot pressurized water and coffee particles; which liquid extracts is finally forced to pass through the orifices 12 of first layer 9. As the pressure builds in the capsule, the second layer 10 tends to deform outwardly, i.e., against capsule holder 16. The areas 20 of the lower layer 10 which are positioned above the recessed elements 18 tend to be more deformed than the areas 21 which are supported by the relief elements 17. As the first layer 9 opposes a lesser resistance to pressure, it deforms proportionally less than the second layer 10. This differential deformation of the delivery wall 3 causes the production of confined areas 22 for the liquid to flow between the two layers. However, since at least a part of the orifices 12, 13 are offset one another, the liquid flow is obliged to take a tortuous path in the confined areas 22 between the two layers 9, 10 until it finds its way out through the second (outer) layer and orifices 13. Furthermore, the confined tortuous flow path can be obtained by blocking areas created by the pressure on the capsule holder, e.g., at relief elements, where the two layers are maintained in contact. As a result, the release of the flow is not straight but sufficiently tortuous and confined to maintain a certain pressure inside the chamber. Once the injection of hot water in the capsule ceases, the capsule still empties from liquid as the deformation of the second layer is preferably permanent thereby maintaining the flow path between the orifices 12, 13 sufficiently opened.

Figure 4:
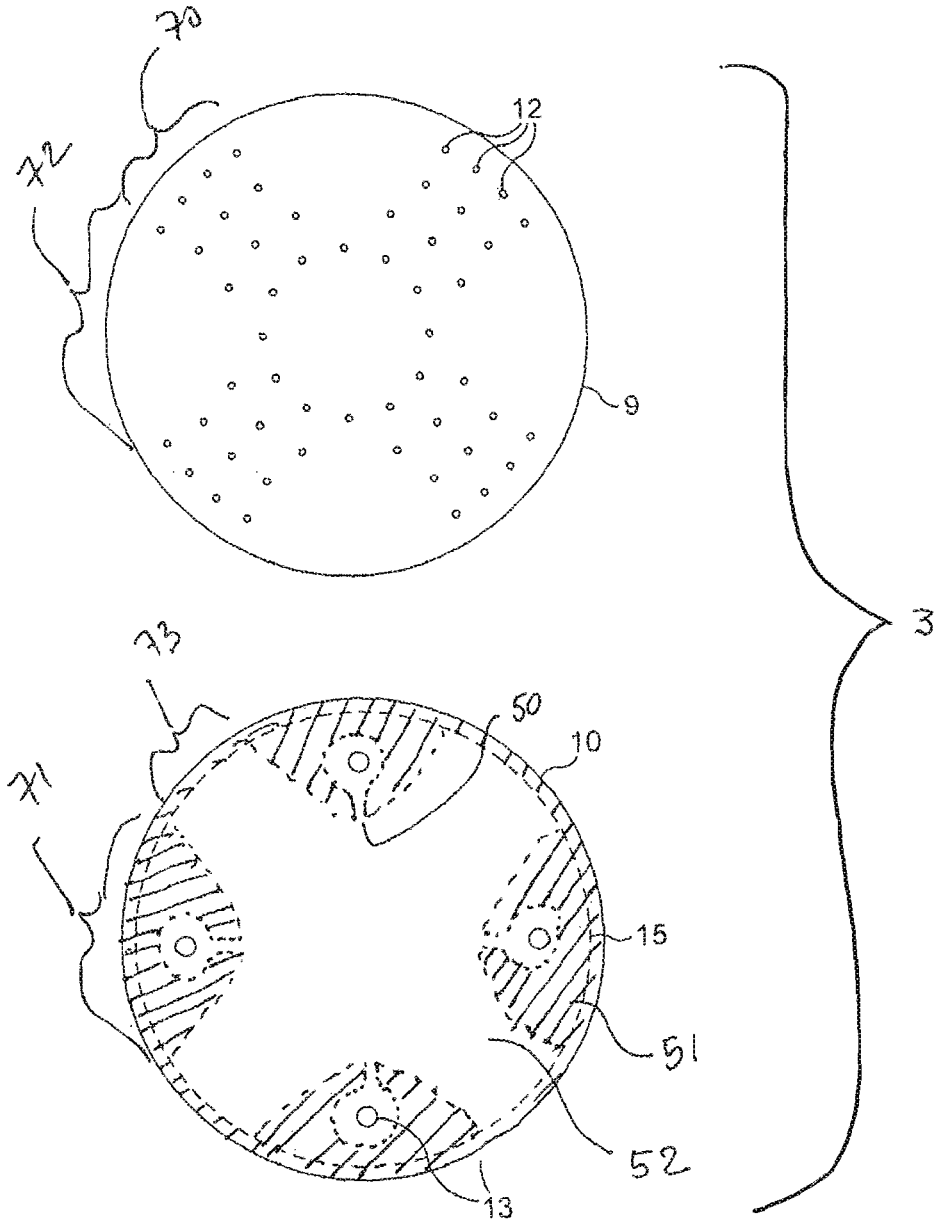
FIG. 4 is an exploded view of the delivery wall of a second embodiment of the capsule of FIG. 1.

FIG. 4 proposes a variant of the delivery wall of the capsule of FIGS. 1 to 3. The capsule is the same or similar to the capsule 1A except in the way the delivery wall is designed. In particular, the inner and outer layers 9, 10 are selectively sealed together to form beverage restriction openings 50 positioned between the second orifices 12 and the first orifices 13. The orifices 12 in the inner layer 9 can be arranged in localized areas 70 of the layer. The orifices 13 of the outer layer are arranged in areas 71 of the outer layer which are axially offset relative to the areas 70 of the orifices 12 of inner layer. More particularly, when the two layers are assembled to form the delivery wall, the areas 70 for the outer orifices 70 become superimposed with non-perforated areas 73 of the outer layer. Similarly, the areas 71 for the outer orifices 13 become superimposed with the non-perforated areas 72 of the inner layer 9. The openings 50 are oriented transversally relative to the orifices. More particularly, the sealing portion 51 connecting the inner layer 9 to the outer layer 10 is designed to restrict the beverage flowpath in the transversal direction on its way to the outlet orifices 13.

More particularly, the sealing portion 51 delimits restriction openings 50, e.g., forming channels, between the unsealed area 52 and the sealed area 51 of the layers. Therefore, the openings 50 are formed by unsealed adjacent portions of the layers and also extend in the transversal direction of the delivery wall, i.e. along plane P of FIG. 1A. The resistance of the seal portion should be sufficient to resist the pressure of beverage and avoids delamination or breakage thereby ensuring the control of the dimensions of the restriction openings.

For the beverage to leave the capsule through the delivery wall, it has to pass through the inner layer 9 via the first orifices 12 to enter the unsealed region 52 which does not comprise any through-orifices in the outer layer, thereby forcing it to change direction and travels transversally in the confined area 22 between the two layers until it flows through the transversally oriented openings 50 and to change again direction (i.e., turning to an axial direction) to pass through the second orifices 13 provided in the outer layer. As a result, the beverage flow is given a tortuous and restricted flow path in the delivery wall which promotes the maintenance of a pressure gradient in the capsule during the beverage extraction.

It should be noted that instead of a continuous sealed portion 51, discrete sealed portions can be provided between the two layers. Also, the openings 50 can be obtained or delimited by rigid inserts which are sealed between the two layers such as small portions of tube, bundles of wires, corrugated plastic pieces, etc.

Figure 5:
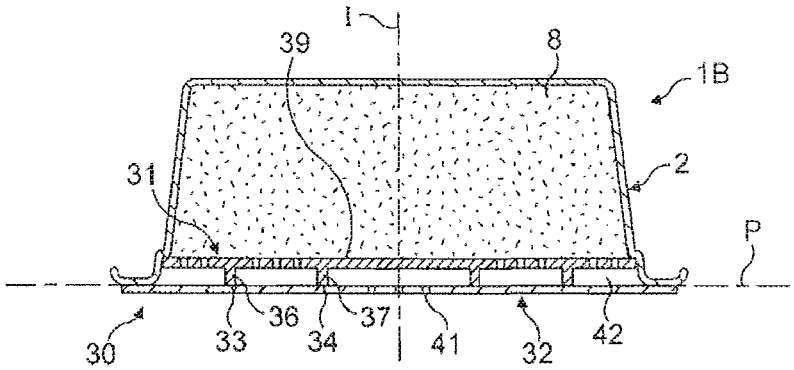
FIG. 5 is a cross section view of a capsule according to a third embodiment of the invention.
Figure 6:
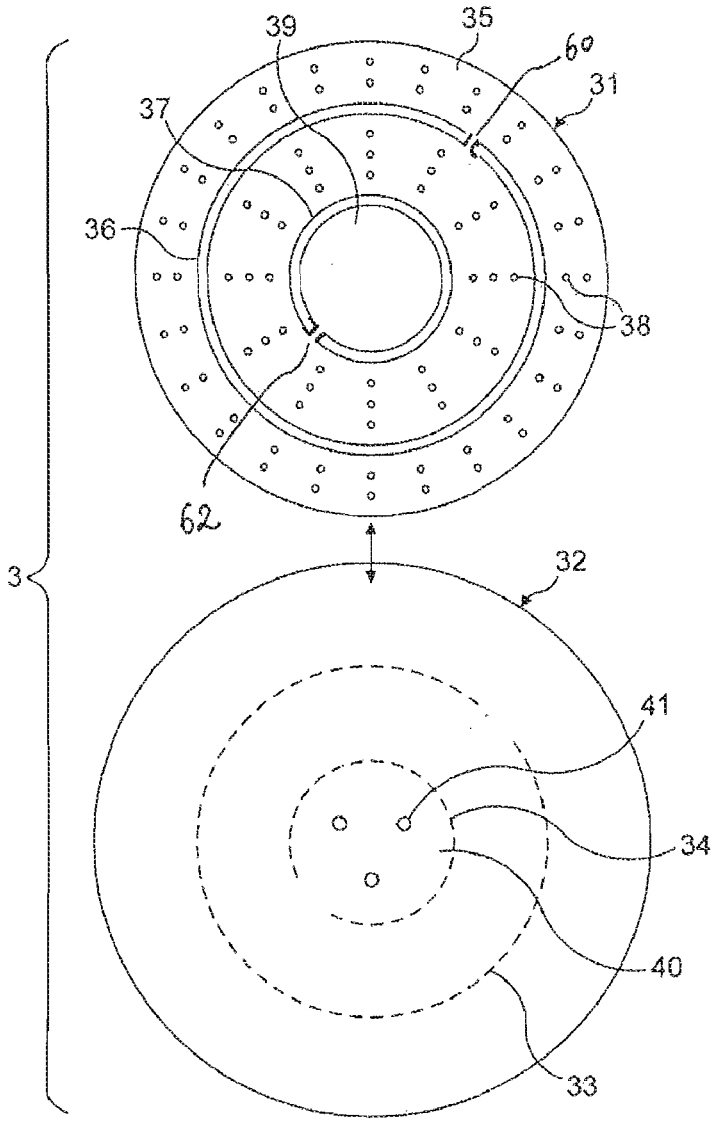
FIG. 6 is an exploded view of the delivery wall of the capsule of FIG. 5.

FIGS. 5 and 6 illustrate another embodiment of the invention in which the capsule 1B comprises a cup-shaped body 2 having a chamber 8 for the ingredients and a delivery wall 30 for closing the chamber. The delivery wall is formed of an inner layer 31 and an outer layer 32 separated by a labyrinth structure 36, 37 for providing a confined tortuous flow path by the presence of a small gap 42 between the two layers. The gap between the two planar layers 31, 32 is of small thickness, preferably smaller than 1.5 mm, most preferably smaller than 1.0 mm, e.g., between 0.2 and 1 mm.

The inner layer 31 is a rigid plastic element comprising a perforated planar wall 35 and raised portions 36, 37 protruding in the direction of the outer planar layer 32. The perforated wall 35 comprises a plurality of orifices 38 sufficiently small to retain the coffee particles inside the chamber 8 (e.g., orifice diameter lower than 150 microns). In the central area 39 of the first layer 31, delimited by the most centrally positioned raised portion 37, the wall is devoid of any orifices. The raised portions can be shaped and positioned as concentric rings. In the raised portions 36, 37 are formed small transversal openings 60, 62 offering a restriction passage for the beverage flow path. For instance, each of the raised portions has a single restriction opening for forcing the beverage flow to get around the portion to find its way out. Furthermore, the openings can be placed on each ring-shaped portion at 180 degree from each other as illustrated in FIG. 6. Preferably, the openings 60, 61 are of very small cross section sufficient to generate a gradient of pressure in the capsule. For example, the cross section is comprised between 0.25 and 2.5 $mm^2$.

Of course, the delivery wall of capsule 1B of FIGS. 5 and 6 may as well comprise a single raised ring-shaped portion, e.g., portion 37 and a single restriction opening, e.g., 62, in which case the second raised ring-shaped portion is omitted. Also, the shape of the raised portions is not limited but preferably they should provide a labyrinth enabling to form a limited number of restriction openings.

As apparent in FIG. 6, the two layers can be selectively sealed together at the free ends of the raised portions 36, 37, at sealing lines 33, 34 on layer 32 (materialized by the dotted lines), for forming a connected delivery wall and avoiding possible bypass of the restriction opening(s) by the beverage. By sealing the layers together, it is assured that the beverage entering the gap is forced through the restriction opening(s) 60, 62.

It should be noted that the transversal restrictions openings of the delivery wall of any of the described capsules 1A, 1B can be sealed before use of the capsule by a breakable seal connecting the two layers. The seal could be broken by the pressure of liquid in the capsule or by mechanical means.

Also, when a gap is present, the labyrinth structure can be obtained by an independent insert or inserts placed between the inner and outer layers.

Also, the delivery wall can formed in part or totally in the body itself, e.g., forming a part or all of the bottom of the body. For instance, the body can be a cup-shaped element wherein the bottom forms the inner or outer layers.

Also, the capsule may already have an open injection wall which does not need to be pierced by blades.

Finally, additional layers can be associated to the delivery wall such as a protective, gas-impermeable layer covering the outer layer and removable before use of the capsule.

Although the capsule is particularly designed for delivering a coffee beverage from ground coffee, it can contain ingredients chosen amongst the list of: ground coffee, soluble coffee, leaf tea, soluble tea, milk powder, chocolate powder, cocoa powder and combinations thereof. Other beverages or liquid foods that can be formed from particulate beverage or food forming ingredients can be provided in the capsule when such beverages or liquid foods are to be made from the capsules of the invention.

What is claimed is:

1. A capsule for preparation of a beverage or liquid food in a beverage production machine, the capsule comprising a body and a delivery wall forming a chamber containing an extractable beverage ingredient, with the delivery wall comprising at least one outlet, a first layer including a plurality of first orifices and a second layer including a plurality of second orifices, wherein the first and second orifices extend in the axial direction of the capsule, wherein the first and second layers are distant by a confined gap, and wherein a labyrinth structure is provided which extends transversally in the gap between the first and second orifices.

2. The capsule according to claim 1, wherein second orifices are offset relative to the first orifices in the transversal direction of the capsule.

3. The capsule according to claim 2, wherein the flowpath between the first orifices and/or second orifices is closed or sealed.

4. The capsule according to claim 2, wherein the flowpath between the first orifices and/or second orifices is let open or non-sealed.

5. The capsule according to claim 2, wherein the flowpath between the first and second orifices is opened by the internal pressure applied to the delivery wall during extraction.

6. The capsule according to claim 1, wherein the delivery wall further comprises one or more restriction opening(s) in the flowpath between the two layers and extending along the transversal direction of the capsule.

7. The capsule according to claim 6, wherein the restriction opening(s) forms an overall open surface area between 0.25 and 2.5 $mm^2$.

8. The capsule according to claim 6 , wherein the transversal flow restriction opening(s) has (have) a larger dimension of less than 1 mm.

9. The capsule according to claim 6, wherein the number of opening(s) is comprised between 1 and 4.

10. The capsule according to claim 6, wherein the inner and outer layers are selectively and partially fixedly sealed together to leave said transversal opening(s).

11. The capsule according to claim 10, wherein the transversal opening(s) is (are) formed in an unsealed portion and delimited by a sealed portion.

12. The capsule according to claim 9, wherein the transversal opening(s) is (are) formed or delimited by a rigid insert.

13. The capsule according to claim 8, wherein the labyrinth structure is arranged to leave at least one flow restriction opening extending in the transversal direction of the capsule.

14. The capsule according to claim 1, wherein the first orifices of the first layer have a diameter small enough to maintain the extractable ingredients particles in the chamber.

15. The capsule according to claim 14, wherein the diameter of the orifices of the first layer is smaller than 100 to 150 microns.

16. The capsule according to claim 1, wherein the first and second layers are disc-shaped.

17. The capsule according to claim 1, which contains particulates for formation of a beverage or liquid food.

18. The capsule according to claim 1, wherein the first and second layers are positioned to be no further apart than 0.3 mm from each other along at least 75% of their total surfaces.

19. The capsule according to claim 2, wherein the first layer has a greater number of first orifices than the number of second orifices in the second layer.

* * * * *